US006336221B1

(12) United States Patent
Blauer et al.

(10) Patent No.: US 6,336,221 B1
(45) Date of Patent: Jan. 8, 2002

(54) UNLINED WATERPROOF CLOTHING

(75) Inventors: Stephen J. Blauer, Lexington, MA (US); Mark A. Mordecai, Hampton, NH (US); Toufic G. Atallah, Reading, MA (US)

(73) Assignee: Blauer Manufacturing Company, Inc., Boston, MA (US)

( * ) Notice: Subject to any disclaimer, the term of this patent is extended or adjusted under 35 U.S.C. 154(b) by 0 days.

(21) Appl. No.: 09/707,098

(22) Filed: Nov. 6, 2000

(51) Int. Cl.[7] ..... A41D 3/04

(52) U.S. Cl. ..... 2/87; 2/82; 2/93; 2/97; 2/904

(58) Field of Search ..... 2/82, 87, 93, 97, 2/247, 252, 267, 268, 272, 275, 904

(56) References Cited

U.S. PATENT DOCUMENTS 4,147,829 A * 4/1979 Holland ..... 428/311
5,173,968 A * 12/1992 Fox ..... 2/244
5,264,276 A * 11/1993 McGregor et al. ..... 428/252
5,364,678 A * 11/1994 Lumb et al. ..... 428/96
5,526,532 A * 6/1996 Willard ..... 2/69
5,569,507 A * 10/1996 Goodwin et al. ..... 428/76
5,593,754 A * 1/1997 Blauer et al. ..... 428/131
5,697,101 A * 12/1997 Aldridge ..... 2/81
5,884,332 A * 3/1999 Snedeker ..... 2/97

* cited by examiner

*Primary Examiner*—John J. Calvert
*Assistant Examiner*—Robert H. Muromoto, Jr.
(74) *Attorney, Agent, or Firm*—Morse, Altman & Martin

(57) ABSTRACT

A well styled, single layer shell jacket is waterproof and windproof, yet possesses the various characteristics of conventionally comfortable clothing, and permits the stitching of emblems thereon without impairing waterproof and windproof characteristics. A seam of stitching joins each pair of the contiguous edges of adjacent sections of this jacket. Superposed on the waterproof and windproof fabric of each sleeve and forming a pocket thereon is a superposed upper patch, which appears to be a continuation of the yoke and the edges of which are joined to the sleeve by seams of stitching. In the patch is a zipper or other closure. This closure, when opened, permits entry into the pocket and sewing of an emblem or the like on the patch without affecting the waterproof and windproof construction of the remainder to the jacket. This closure, when closed, permits easy access to gloves, eye wear, medicines, or other items stored in the pocket. The opposed bands that carry the mating elements of each zipper, are composed of a waterproof plastic, and are fastened in position by lines of stitching. Waterproofing strips of thermoplastic tape seal all of the aforementioned lines of stitching.

20 Claims, 5 Drawing Sheets

UNLINED WATERPROOF CLOTHING

BACKGROUND OF THE INVENTION

1. Field of the Invention

The present invention relates to clothing and, more particularly, to uniforms that have waterproof and windproof jackets or other clothing components of the type used in inclement environments by personnel involved in law enforcement, emergency medicine, fire and safety service, general work service, and the like.

2. The Prior Art

Water resistant and wind resistant clothing, including waterproof and windproof jackets and other clothing, often have incorporated combinations and sequences of different layers, such as a fleece or wool layer for warmth, a microporous membrane layer for vapor permeability, and/or a hydrophobic layer for truly effective waterproofing and windproofing. Such jackets often have been adapted only for specific seasonal and/or inclement conditions. Thus, for example, such jackets may not be designed to repel blood or other bodily fluids that may be encountered by emergency medical workers. Single layer waterproof and windproof shells are adapted for use in a variety of seasonal and/or inclement conditions in the sense that the wearer can select a sweater and/or other underlying garment to meet individual needs or preferences. In the past, single layer waterproof and windproof shells have been typified by rubber or plastic coatings or other non-textile strata. It usually is not feasible to sew emblems on articles of clothing so constructed without impairing their waterproof and windproof character. Furthermore, such shells generally do not have the acceptable aesthetic appearance or the hand and feel of conventionally comfortable clothing. It is desired to provide a single layer shell jacket or other outerwear, which is truly waterproof and windproof, which is adapted for vicarious use with individualized under-layers of clothing, which may possess the aesthetic appearance and hand and feel that characterize conventionally comfortable clothing, and which permits the stitching of emblems thereon without impairing waterproof and windproof characteristics.

SUMMARY OF THE INVENTION

The primary object of the present invention is to provide, for a human wearer, a well-styled, single layer shell outerwear, particularly a jacket, which is waterproof and windproof, yet which possesses the various characteristics of conventionally comfortable clothing, and which permits the stitching of emblems thereon without impairing waterproof and windproof characteristics. This outerwear comprises body sections, arm sections, a yoke section, a waist section, and a collar section, all of a waterproof, windproof and breathable fabric of a specific construction and composition. The yoke section extends across the wearer's shoulders from arm to arm, and over the wearer's shoulders about the collar section. A seam of stitching joins the contiguous edges of each pair of adjacent sections. In a preferred embodiment, the body sections, which extend between the yoke section and the waist section, have left and right front flies, which hide zippered pockets that extend substantially from the shoulder section to the waist section. Stitched to each sleeve and forming a pocket thereon is a patch, which is surrounded by a seam. In the patch and within the seam is a zipper or other closure. This closure, when opened, permits entry into the pocket and sewing of an emblem or the like on the patch without affecting the waterproof and windproof construction of the remainder to the jacket. This closure, when closed, permits easy access to gloves, eye wear, medicines, or other items stored in the pocket. The opposed bands that carry the mating elements of each zipper are fastened in position by seams of stitching. Waterproofing strips of thermoplastic tape seal all of the aforementioned seams of stitching. The arrangement is such that local dealers and users can stitch emblems to the pockets without affecting the waterproof and windproof character of the clothing.

Other objects of the present invention will in part be obvious and will in part appear hereinafter.

BRIEF DESCRIPTION OF THE DRAWINGS

For a fuller understanding of the nature and object of the present invention, reference is made to the accompanying drawings, wherein.

DETAILED DESCRIPTION OF THE PREFERRED EMBODIMENTS

The Embodiment of FIGS. 1 through 5

Figure 1:
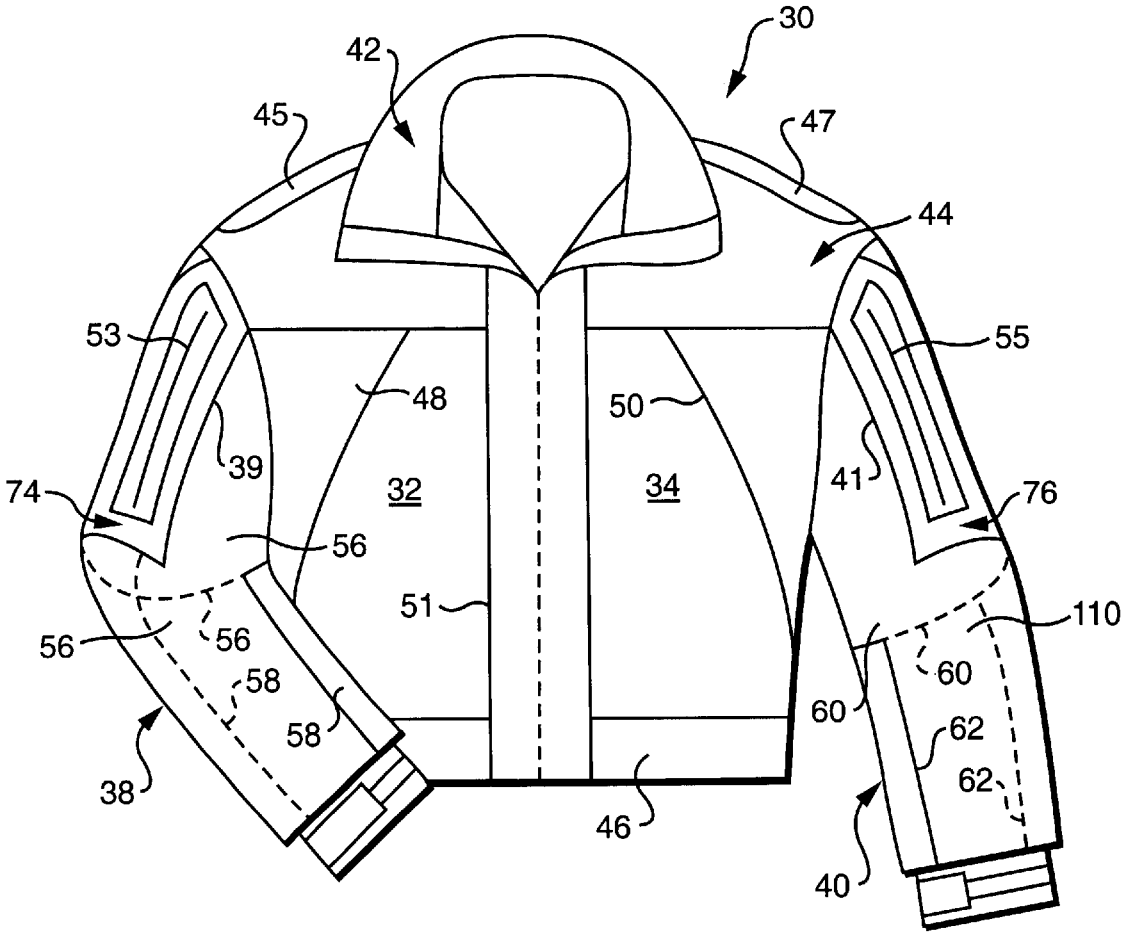
FIG. 1 is a front view of a jacket of conventional appearance embodying the present invention.
Figure 2:
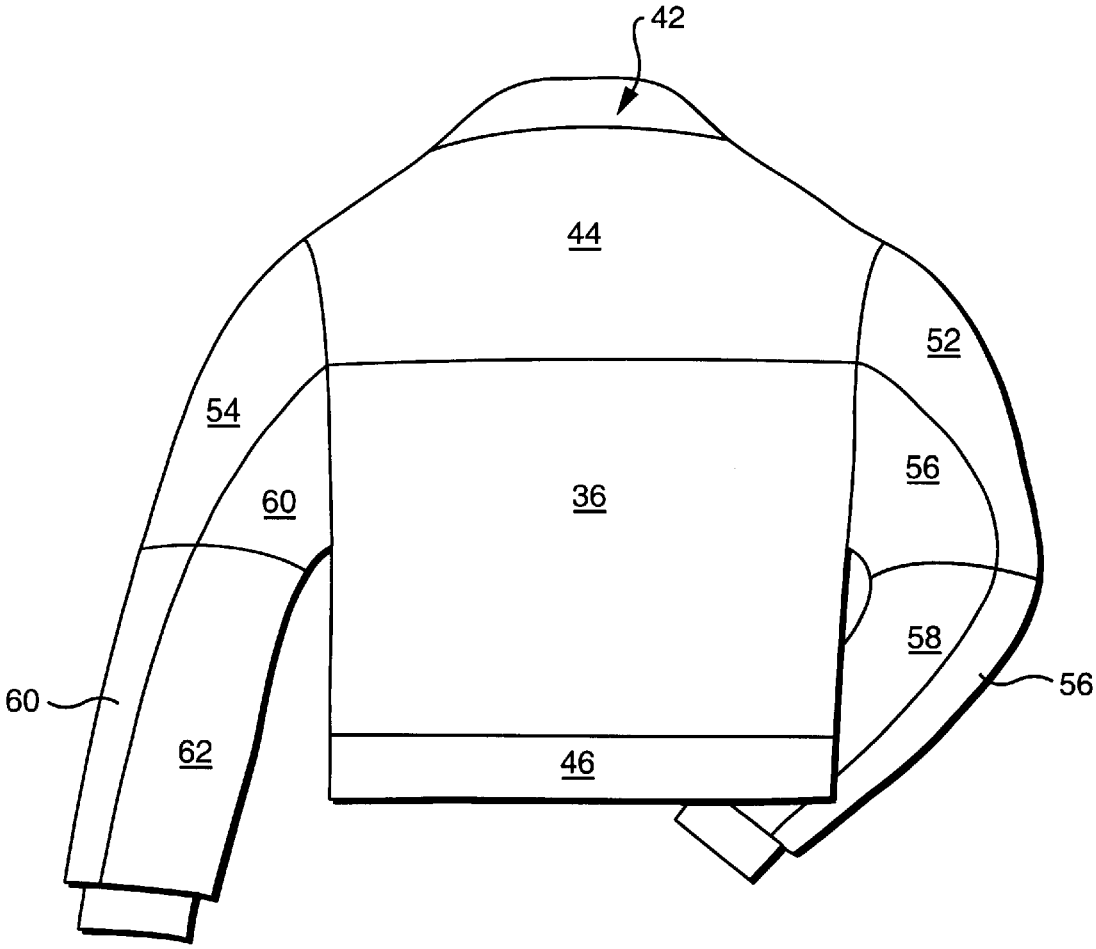
FIG. 2 is a back view of the jacket of FIG. 1.

FIGS. 1 and 2 illustrate a preferred embodiment of the present invention as a jacket construction 30 comprising left and right body sections 32, 34, a back body section 36, a pair of sleeves 38, 40, a collar 42, a yoke section 44 that extends across a wearer's shoulders from sleeve to sleeve and about collar 42, and a waist section 46 that encompasses a wearer's torso at the lower edges of the left, back and right body sections. Body sections 32, 34, 36 extend between yoke section 44 and waist section 46. Front body sections 32, 34 have left and right flies 48, 50, which hide zippered pockets that extend substantially from yoke section 44 to waist section 46. A center fly 51 hides a zipper that extends from collar 42 to waist section 46. Sleeve 38 is formed from (1) a base section 56 about the upper arm region and extending downwardly to the wrist through the anterior forearm region, and (2) an abrasion resistant section 58 about the elbow and posterior forearm region. Similarly, sleeve 40 is formed from (1) a base section 60 about the upper arm region and extending downwardly to the wrist through the anterior forearm region, and (2) an abrasion resistant section 62 about the elbow and posterior forearm region.

Figure 3:
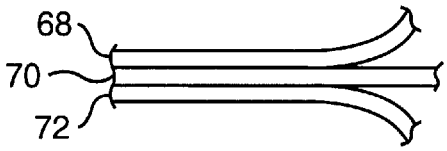
FIG. 3 illustrates the layers of a preferred shell fabric embodying the present invention.

Preferably, each of sections 32, 34, 36, 44, 56, 58, 60, 62 is composed of a waterproof, windproof, breathable laminate of the type shown in FIG. 3 and sold under the trade designation CROSSTECH by W. L. Gore and Associates, Inc., of Elkton, Md., USA. As shown, this laminate comprises an outer facing fabric layer 68, a medial membrane layer 70, and an inner backing fabric layer 72.

Superposed on the laminates of sleeves 38, 40 and stitched thereto along seams 39, 41 to form pockets thereon are upper patches 74, 76. These patches are composed of the same fabric as is facing fabric layer 68 and appear to be continuations of yoke 44. Within patches 74, 76, respectively, are zippers 53, 55 or other closures. These closures, when open, permit entry into the pockets and sewing of emblems or the like on the patches without affecting the waterproof and windproof construction of the sleeves or the remainder of the jacket. These closures, when sealed, permit secure storage of gloves, eye wear, medicines, or other items in the pockets.

Figure 4:
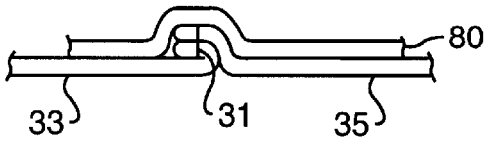
FIG. 4 illustrates the sealing of a seam between waterproof and windproof sections of a garment pursuant to the present invention.
Figure 5:
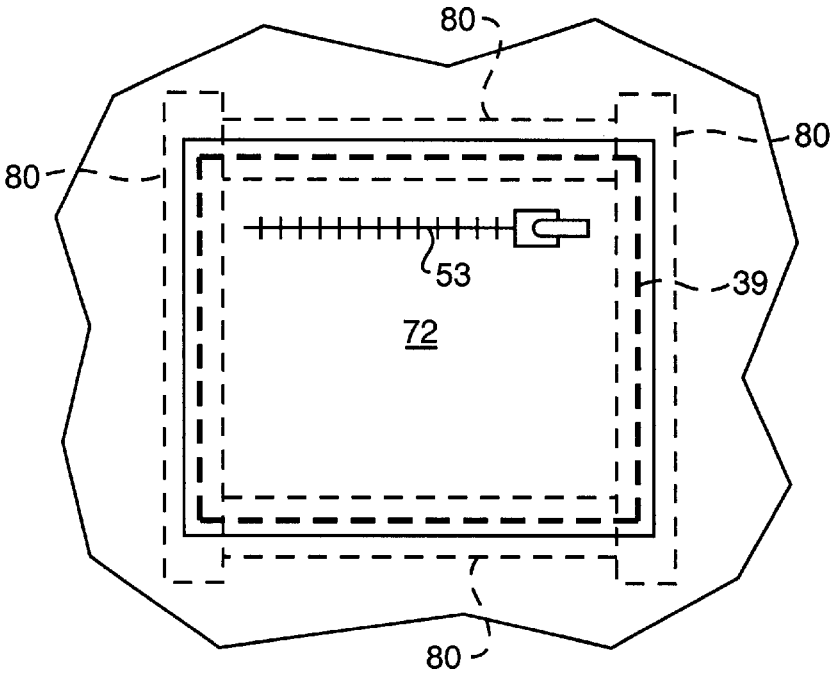
FIG. 5 illustrates the structure of a patch that is stitched and sealed to a waterproof and windproof section of a garment to form a pocket pursuant to the present invention.

As shown in FIG. 4, strips of sealing tape 80 waterproof the seams, as shown at 31, between contiguous edges of respective adjacent sections 32, 34, 36, 44, 56, 58, 60, 62, as shown at 33 and 35. Sealing tape 80 is composed of a polyurethane backing stratum and a thermoplastic adhesive facing stratum that may be activated by heat and pressure. Similarly, as shown in FIG. 5, strips of sealing tape waterproof seams 39, 41, which surround patches 74 and 76 and stitch them to the sleeves. Similarly, strips of the sealing tape serve to waterproof the seams by which the zippers at flies 48, 50, 51 are stitched to their associated sections.

In an alternative embodiment, each of sections 32, 34, 36, 38,40, 42, 44, 46 is replaced by an alternative waterproof, windproof, breathable laminate, which is similar to that shown in FIG. 3 and which is sold under the trade designation GORETEX by W. L. Gore and Associates, Inc., of Elkton, Md., USA. This laminate comprises facing, medial and backing layers that are analogous to their counterparts as shown in FIG. 3, except that the oleophobic polymer is omitted from the medial layer. This alternative structure does not provide resistance against blood-borne pathogen and common chemical liquid penetration.

In another alternative embodiment, each of sections 32, 34, 36, 38,40, 42, 44, 46 is replaced by an alternative waterproof, windproof, breathable laminate that comprises an outer facing fabric layer, a medial membrane layer, and an inner backing or liner fabric layer. The facing and backing layers are analogous to their counterparts as shown in FIG. 3. The medial fabric layer is a film composed of a monolithic, hydrophilic polyurethane of a type sold under the trade designation XALT by Burlington Industries, Inc., Greensboro, N.C., USA.

EXAMPLES

The following non-limiting examples further describe the structure of the jacket of FIGS. 1 through 5.

Example I

Facing fabric layer 48 is composed of a woven polyester having the following specifications. Cloth Type: 100% textured polyester, 70 denier warp and filling, jet dyed, plain weave. Count: Warp—97; Filling—102. Weight: 2.18 oz. per square yard.

Example II

Backing fabric layer 52 is composed of a knit polyester having the following specifications. Cloth type: 32 gauge, 2-bar knit polyester tricot. Denier: Top Bar—40 denier, 20 filaments, Bottom Bar—20 denier, 18 filaments. Count: Wales—40, Courses—46. Color: Black.

Example III

The performance of the laminate of FIG. 3 is primarily a function of membrane layer 70, which consists of expanded polytetrafluoroethylene (ePTFE) that is impregnated with an oleophobic polymer. The ePTFE membrane contains billions of pores per square inch, each being thousands of times smaller than a water droplet but hundreds of times larger than a water vapor molecule. This composition passes perspiration vapor from the inside, but blocks water and wind from the outside. The impregnated oleophobic polymer provides resistance against blood-borne pathogen and common chemical liquid penetration.

Example IV

Further Details of the Jacket of FIGS. 1 through 5 General Design:

The illustrated jacket is hip length and waterproof by design with drop shoulder, equipment strap epaulets, waterproof side zippers (not shown in the drawings), and a front zipper with double outside storm flies, hook and loop adjustable elasticized cuff, two sleeve pockets, two double entry mesh pocket bags with slanted front zipper pocket opening and hidden zipper openings at the stormfly. The center back length is approximately equal to 28.5 inches.

Fronts:

There are top and under storm flaps both covering the front zipper. The top storm flap is constructed of two plies of the CROSSTECH shell fabric, one ply of the woven polyester shell fabric on the top, and one ply of interlining. The under stormflap is constructed of two plies of the CROSSTECH shell fabric and one ply of the woven polyester shell fabric on the top. The top and under stormflaps measure approximately 2.125 inches wide. The under stormflap is up approximately 0.5 inch and secured with seven bartacks evenly spaced to form a gutter. The stormflies extend to the bottom hem of the jacket and to the top of the collar. The stormflies have six snap fasteners for closure. The female snaps are set to the top storm flap through the bottom ply of material and one ply of interlining only so that they are not exposed on the front of the jacket. The male snaps are set through all layers of the under storm flap. The top snap is set 1.5 inches from the top of the storm flap, the second snap shall be set at the neck seam, the bottom snap shall be set approximately 1.5 inches from the bottom of the storm flap. The remaining snaps are evenly spaced. The storm flaps are stitched, turned, edge stitched and set into a front seam approximately 1 inch from the front edge on either side. The slider on the front zipper has a pull cord attached.

Facing:

The front facings are 1.25 inches wide and constructed of one ply of the CROSSTECH shell fabric. The hem facings are 1.75 inches wide and constructed of one ply of the CROSSTECH shell fabric.

Yoke:

The front of the yoke section is constructed of one ply of the CROSSTECH shell fabric and one ply of the woven polyester shell fabric on top. The top back yoke is constructed of one ply of the CROSSTECH shell fabric and one ply of the woven polyester shell fabric on top. There also is a bottom band of woven polyester shell fabric sewn on top of the CROSSTECH shell fabric around the entire jacket measuring 8.5 inches high at the center back, 6 inches high at the side seams and 5.5 inches high at the front edges.

Sleeves:

The sleeves are of 2-piece drop shoulder design with elasticized cuff. The sleeve is constructed of two pieces of the CROSSTECH shell fabric with two patches of woven polyester shell fabric. There is a patch of the woven polyester shell fabric on the top sleeve extending from the shoulder to the elbow and lining up with the front and back of the yoke section. To provide access to the shell for sewing emblems on sleeves without damaging the waterproof, breathable permanent lining, the zipper on the patch is placed vertically on the front side of the sleeve to form a pocket. There is a patch of the woven polyester shell fabric on the under sleeve extending from the elbow to the cuff. The elbow area has two darts to give shape to the arm. The cuff is constructed of one ply of the woven polyester shell fabric on the top side and one ply of the CROSSTECH shell fabric on the underside. The cuff is elasticized on the entire underside and has a tab for adjustment. The 1.5 inch wide elastic is sewn in with 3 rows of stitching. The tab is 2 inches long by 1.5 inches wide and sewn into the inseam. There is a 1.5 inch by 0.625 inch piece of hook sewn to the underside of the tab to fasten to a 5 inch by 0.625 inch wide loop sewn to the top cuff band.

Shoulder Straps:

The permanent shoulder straps as shown at 45 are 2.0 inches wide. The ends of the shoulder straps are sewn into the sleeve joining seam and the collar joining seam of the coat. Shoulder straps are constructed of two plies of the woven polyester shell fabric and one ply of interlining. Shoulder straps topstitched along the periphery with a 0.125-inch gauge and securely bartacked on all four openings leaving a 2.5-inch opening in the center for the user to clip on an external microphone or other equipment.

Collar:

The sport collar is made of three plies of the CROSSTECH shell fabric and one ply of the woven polyester shell fabric. The top collar only is the woven polyester shell fabric. The under collar measures 3.5 inches high at the center back and 4 inches high at the front edge. The top collar measures 2.75 inches high at the center back and 3.25 inches high at the front edge. There is an inner storm flap at neck extending from the top of the collar, which measures 5.75 inches in length inserted under zipper. The inner storm flap is constructed of two plies of woven polyester shell fabric and one ply of interlining. There are three male snaps spaced 3.5 inches apart with closed backs set through the top collar and under collar for attachment of an optional hood.

Side Vents:

There are 10 inch zippered side vent openings (not shown in FIGS. 1 and 2) on each side with 4 inch elasticized snap tab set in the bottom hem on the back of jacket. Each elasticized side tab has a male snap at the end of the tab. There is a female snap on the front and back hems 3 inches from the side opening.

Pockets:

There are two double entry pockets bags that are constructed of three plies of mesh fabric and measure 11 inches high, 12 inches wide at the bottom and 6 inches wide at the top. The pocket bags are accessed by the two front pockets and the two hidden zippered pockets at the front stormflies. The front pockets have 2.5 inch wide angled flaps covering a zipper closure. The sliders on the front pocket zippers have a pull cord attached. The hidden pockets at the front stormflies have a zipper opening set at the front zipper edge and centered vertically with the middle front panel. The pocket has a 0.5 inch ribbon loop folded to finish at 1.5 inches inserted into the top pocket bag seam at the edge of the opening. Optionally sealing the contiguous faces at the edges of the pocket flap are the mating strips (not shown) of a hook and loop closure.

Seam Stitching:

All seams are of single needle construction. All seams are eight stitches per inch minimum to twelve stitches per inch maximum. Seams are free from puckering, pleats, runoffs and raw edges.

Seam Waterproofing:

All seams and stitching through the permanent waterproof breathable lining are waterproof seam taped with the specified seam tape. The tape is applied by hot air methods. The tape is not affected by weather, temperature, or storage. The taped seams have been tested for waterproofing in accordance with Federal Test Std. #1 91A, Method #5516 when new and after 10 wash/dry cycles and dry cleanings. There is no appearance of water in the test area at 2 psi for a period of 3 minutes.

Figure 6:
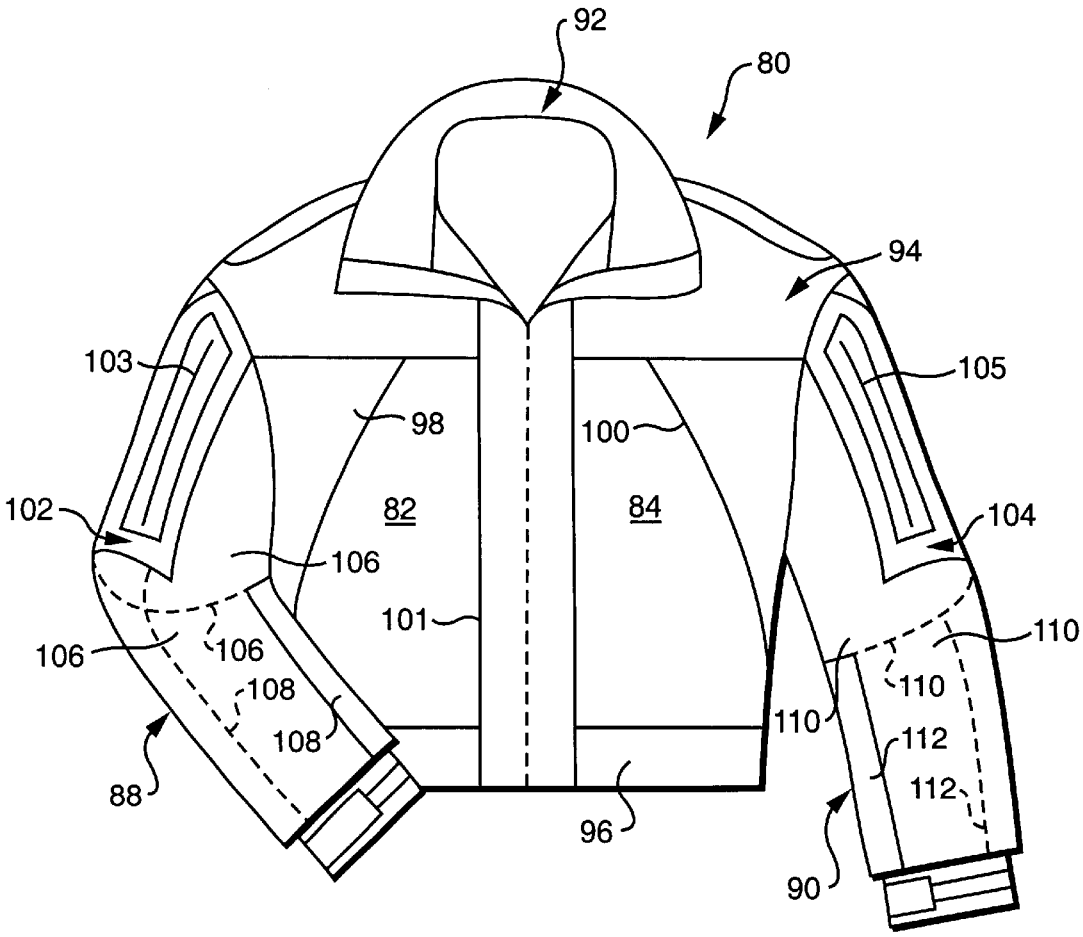
FIG. 6 is a front view of a high visibility jacket embodying the present invention.
Figure 7:
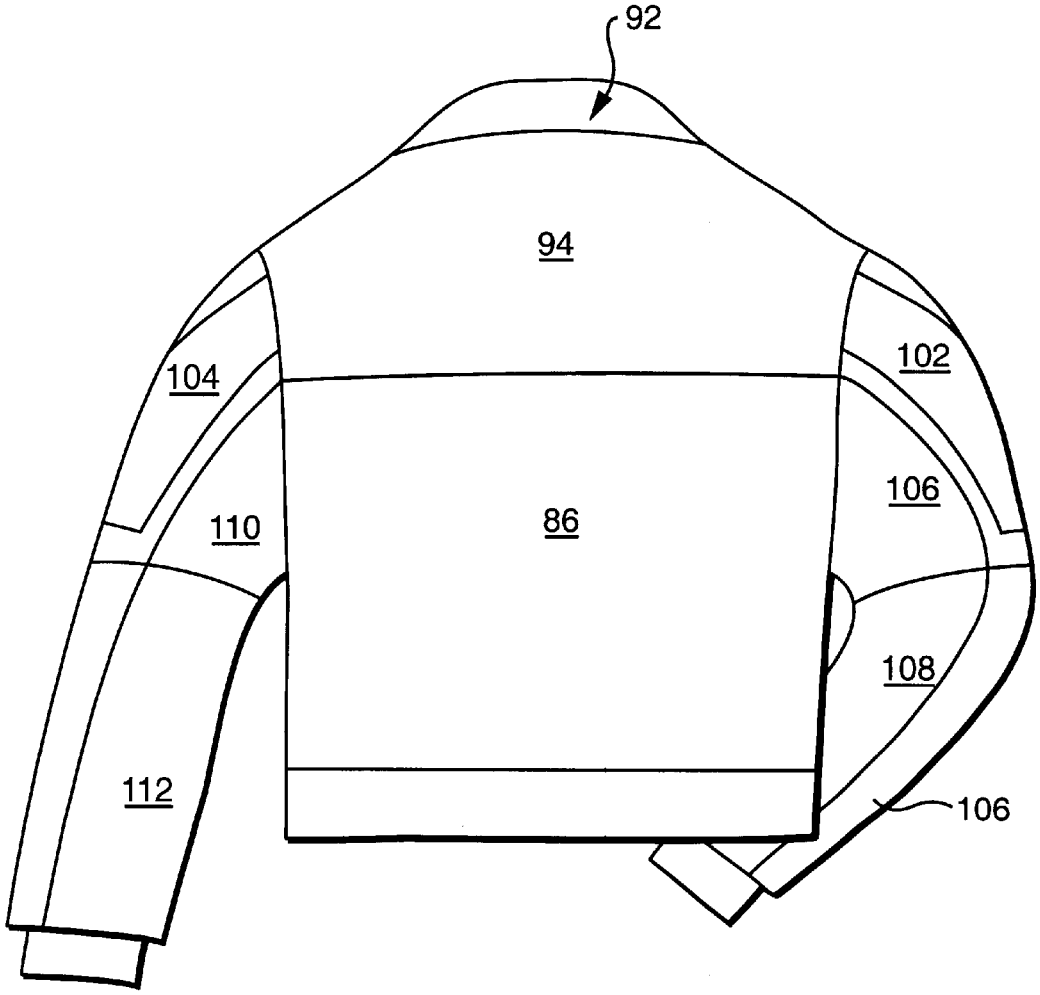
FIG. 7 is a back view of the jacket of FIG. 6.

The Embodiment of FIGS. 6 and 7

FIGS. 6 and 7 illustrate another preferred embodiment of the present invention as a high visibility jacket construction 80 comprising left and right body sections 82, 84, a back body section 86, a pair of sleeves 88, 90, a collar 92, a yoke section 94 that extends across a wearer's shoulders from sleeve to sleeve and about collar 92, and a waist section 96 that encompasses a wearer's torso at the lower edges of the left, back and right body sections. Body sections 82, 84, 86 extend between yoke section 94 and waist section 96. Front body sections 82, 84 have left and right flies 98, 100, which hide zippered pockets that extend substantially from yoke section 94 to waist section 96. A center fly 101 hides a zipper that extends from collar 92 to waist section 96. Sleeve 88 is formed from (1) a base section 106 about the upper arm region and extending downwardly to the wrist through the anterior forearm region, and (2) an abrasion resistant section 108 about the elbow and posterior forearm region. Similarly, sleeve 90 is formed from (1) a base section 110 about the upper arm region and extending downwardly to the wrist through the anterior forearm region, and (2) an abrasion resistant section 112 about the elbow and posterior forearm region.

Preferably, each of sections 82, 84, 86, 94, 106, 108, 110, 112 is composed of a waterproof, windproof, breathable laminate of the type shown in FIG. 3 and sold under the trade designation CROSSTECH by W. L. Gore and Associates, Inc., of Elkton, Md., USA. As shown, this laminate comprises an outer facing fabric layer 98, a medial membrane layer 100, and an inner back fabric layer 102. In this embodiment, the facing fabrics of sections 82, 84, 86, 94, 108, 110 are composed of polyester that has been impregnated with a fluorescent dye in one embodiment, or a dispersion of retroreflective beads in another embodiment.

Superposed on the laminates of sleeves 88, 90 and stitched thereto along seams 89, 91 to form pockets thereon are upper patches 102, 104. These patches are composed of the same fabric as is facing fabric layer 98. Within patches 102, 104, respectively, are zippers 103, 105 or other closures. These closures, when open, permit entry into the pockets and sewing of emblems or the like on the patches without affecting the waterproof and windproof construction of the sleeves or the remainder of the jacket. These closures, when sealed, permit secure storage of gloves, eye wear, medicines, or other items in the pockets.

OPERATION

A well styled, single layer shell jacket is waterproof and windproof, yet possesses the various characteristics of conventionally comfortable clothing, and permits the stitching of emblems thereon without impairing waterproof and windproof characteristics. A seam of stitching joins each pair of the contiguous edges of adjacent sections of this jacket. Superposed on the waterproof, windproof and breathable fabric of each sleeve and forming a pocket thereon is a superposed upper patch, which appears to be a continuation of the yoke and the edges of which are joined to the sleeve by seams of stitching. In the patch is a zipper or other closure. This closure, when opened, permits entry into the pocket and sewing of an emblem or the like on the patch without affecting the waterproof and windproof construction of the remainder to the jacket. This closure, when closed, permits easy access to gloves, eye wear, medicines, or other items stored in the pocket. The opposed bands that carry the mating elements of each zipper, are composed of a waterproof plastic, and are fastened in position by lines of stitching. Waterproofing strips of thermoplastic tape seal all of the aforementioned lines of stitching.

Thus it has been shown and described a water-proof and wind-proof jacket which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. For a human wearer, a well styled, single layer shell jacket comprising:

(a) left anterior body section, a right anterior body section, a posterior body section, a left arm, a right arm, a yoke section, a waist section, and a collar, said yoke section extending across the wearer's shoulders from arm to arm, and over the wearer's shoulders about said collar, each pair of the contiguous edges of adjacent sections being stitched to each other joined by a seam of stitching;

(b) said left anterior body section, said right anterior body section, said posterior body section, said left arm, and said right arm, each being composed of a waterproof, windproof laminate that includes an outer facing fabric layer, a medial membrane layer, and a backing fabric layer, said medial membrane layer being waterproof, windproof and vapor permeable;

(c) a left patch stitched on said left sleeve along seams that encompass said left patch to form a left pocket, and a right patch stitched on said right sleeve along seams that encompass said right patch to form a right pocket, a closure in said left patch within said seams of said left patch for access to said left pocket, a closure in said right patch within said seams of said right patch for access to said right pocket; and (d) thermoplastic strips of waterproof tape bonded to said backing fabric layers along said seams.

2. The jacket of claim 1 wherein said facing fabric layer is woven.

3. The jacket of claim 1 wherein said backing fabric layer is knitted.

4. The jacket of claim 1 wherein said membrane layer consists of expanded polytetrafluoroethylene.

5. The jacket of claim 1 wherein said membrane layer consists of expanded polytetrafluoroethylene that is impregnated with an oleophobic polymer.

6. The jacket of claim 1 wherein said membrane contains billions of pores per square inch, each being thousands of times smaller than a water droplet but hundreds of times larger than a water vapor molecule, whereby said membrane passes perspiration vapor from the inside, but blocks water and wind from the outside.

7. The jacket of claim 1 wherein said facing fabric layer of certain of said sections is fluorescent.

8. The jacket of claim 1 wherein said facing fabric layer of certain of said sections is retroreflective.

9. The jacket of claim 1 wherein said facing fabric layer is woven, said backing fabric layer is knitted, and said membrane layer includes expanded polytetrafluoroethylene.

10. The jacket of claim 1 wherein said membrane layer consists of expanded polytetrafluoroethylene that is impregnated with an oleophobic polymer, said membrane containing billions of pores per square inch, each being thousands of times smaller than a water droplet but hundreds of times larger than a water vapor molecule, whereby said membrane passes perspiration vapor from the inside, but blocks water and wind from the outside.

11. A jacket construction comprising left and right body sections, a back body section, a pair of sleeves, a collar section, a yoke section that extends across a wearer's shoulders from sleeve to sleeve and about said collar section, and a waist section that encompasses a wearer's torso at the lower edges of said left, back and right body sections, said body sections extending between said yoke section and said waist section, each of said sleeves being formed from (1) a base section about the upper arm region and extending downwardly to the wrist through the anterior forearm region, and (2) an abrasion resistant section about the elbow and posterior forearm region, said front body sections having left and right flies and zippered pockets hidden thereby extending diagonally substantially from said yoke section to said waist section, seams of stitching connection contiguous edges of said sections, each of said sections being a laminate of a facing fabric layer, an intermediate membrane layer and a backing fabric layer, the edge of one of said front body sections having a center fly and said front body sections having a zipper under said center fly and extending from said collar section to said waist section, patches stitched on said sleeves along seams that encompass said patches to form pockets, and closures in said patches within said seams of said patches for access to said pockets, and thermoplastic strips of waterproof tape bonded to said backing fabric layers along said seams.

12. The jacket of claim 11 wherein said membrane layer consists of expanded polytetrafluoroethylene that is impregnated with an oleophobic polymer.

13. The jacket of claim 11 wherein said membrane contains billions of pores per square inch, each being thousands of times smaller than a water droplet but hundreds of times larger than a water vapor molecule, whereby said membrane passes perspiration vapor from the inside, but blocks water and wind from the outside.

14. The jacket of claim 13 wherein said oleophobic polymer provides resistance against blood-borne pathogen and common chemical liquid penetration.

15. The jacket of claim 11 wherein said membrane is a monolithic hydrophilic polyurethane.

16. The jacket of claim 11 wherein said facing fabric layer is woven, said backing fabric layer is knitted, and said membrane layer includes expanded polytetrafluoroethylene.

17. The jacket of claim 11 wherein said membrane layer consists of expanded polytetrafluoroethylene that is impregnated with an oleophobic polymer, said membrane containing billions of pores per square inch, each being thousands of times smaller than a water droplet but hundreds of times larger than a water vapor molecule, whereby said membrane passes perspiration vapor from the inside, but blocks water and wind from the outside.

18. For a human wearer, single layer shell outerwear comprising:

(a) left anterior body section, a right anterior body section, a posterior body section, a left arm, a right arm, a yoke section, and a collar, said yoke section extending across the wearer's shoulders from arm to arm, and over the wearer's shoulders about said collar, each pair of the contiguous edges of adjacent sections being stitched to each other joined by a seam of stitching;

(b) said left anterior body section, said right anterior body section, said posterior body section, said left arm, and said right arm, each being composed of a waterproof stratum;

(c) a left patch stitched on said left sleeve along seams that encompass said left patch to form a left pocket, and a right patch stitched on said right sleeve along seams that encompass said right patch to form a right pocket, a closure in said left patch within said seams of said left patch for access to said left pocket, a closure in said right patch within said seams of said right patch for access to said right pocket; and (d) thermoplastic strips of waterproof tape bonded in contiguity with the back of said stratum along said seams.

19. For a human wearer, single layer shell outerwear comprising:

(a) left anterior body section, a right anterior body section, a posterior body section, a left arm, a right arm, a yoke section, and a collar, said yoke section extending across the wearer's shoulders from arm to arm, and over the wearer's shoulders about said collar, each pair of the contiguous edges of adjacent sections being stitched to each other joined by a seam of stitching;

(b) said left anterior body section, said right anterior body section, said posterior body section, said left arm, and said right arm, each being composed of a waterproof stratum;

(c) a left patch stitched on said left sleeve along seams that encompass said left patch to form a left pocket, and a right patch stitched on said right sleeve along seams that encompass said right patch to form a right pocket, a closure in said left patch within said seams of said left patch for access to said left pocket, a closure in said right patch within said seams of said right patch for access to said right pocket; and (d) thermoplastic strips of waterproof tape bonded in contiguity with the back of said stratum along said seams;

(e) said waterproof stratum having a woven fabric facing.

20. For a human wearer, single layer shell outerwear comprising:

(a) left anterior body section, a right anterior body section, a posterior body section, a left arm, a right arm, a yoke section, and a collar, said yoke section extending across the wearer's shoulders from arm to arm, and over the wearer's shoulders about said collar, each pair of the contiguous edges of adjacent sections being stitched to each other joined by a seam of stitching;

(b) said left anterior body section, said right anterior body section, said posterior body section, said left arm, and said right arm, each being composed of a waterproof stratum;

(c) a left patch stitched on said left sleeve along seams that encompass said left patch to form a left pocket, and a right patch stitched on said right sleeve along seams that encompass said right patch to form a right pocket, a closure in said left patch within said seams of said left patch for access to said left pocket, a closure in said right patch within said seams of said right patch for access to said right pocket; and (d) thermoplastic strips of waterproof tape bonded in contiguity with the back of said stratum along said seams;

(e) said waterproof stratum having a knitted fabric backing.

* * * * *